US005619951A

United States Patent [19]

Constantinis

[11] Patent Number: 5,619,951

[45] Date of Patent: Apr. 15, 1997

[54] SYSTEM FOR LAUNCHING A LIFEBOAT

[75] Inventor: Daniel A. Constantinis, Wilmslow, England

[73] Assignee: E M & I (Safety Systems) Limited, Cheshire, England

[21] Appl. No.: 464,821

[22] PCT Filed: Oct. 25, 1993

[86] PCT No.: PCT/GB93/02200

§ 371 Date: Jun. 30, 1995

§ 102(e) Date: Jun. 30, 1995

[87] PCT Pub. No.: WO94/10028

PCT Pub. Date: May 11, 1994

[30] Foreign Application Priority Data

Oct. 27, 1992 [GB] United Kingdom ..... 9222517

[51] Int. Cl.[6] ..... B63B 23/30

[52] U.S. Cl. ..... 114/365; 114/253; 114/376

[58] Field of Search ..... 114/253, 365, 114/375, 376, 293, 368; 182/48; 441/3

[56] References Cited

U.S. PATENT DOCUMENTS 3,796,281 3/1974 Dowling ..... 182/48
4,711,196 12/1987 Wilks ..... 114/365

FOREIGN PATENT DOCUMENTS

91/03398 3/1991 WIPO .

*Primary Examiner*—Sherman Basinger
*Attorney, Agent, or Firm*—Nies, Kurz, Bergert & Tamburro

[57] ABSTRACT

A system for launching a lifeboat (11) from davits (12) on an offshore drilling platform (10) comprises a submerged buoyancy device (10) tethered to the bow of the lifeboat (11) by a cable (13) which passes between the buoyancy device and the lifeboat. The cable is retained by a release mechanism (14) attached to the platform just above the water line and extends upwardly from a guide fairlead (18) attached to the sea bed, between the latter and the lifeboat (11). In some cases the release mechanism (14) may be omitted or alternatively two release mechanisms may be provided above the water line.

7 Claims, 3 Drawing Sheets

SYSTEM FOR LAUNCHING A LIFEBOAT

BACKGROUND AND SUMMARY OF THE INVENTION

This invention concerns a system for launching a lifeboat, rescue craft or like vessel, hereinafter referred to generally as a lifeboat, whether of solid or inflatable construction, from a fixed or semi-submersible marine platform or other structure.

An object of the present invention is to provide a safe and reliable system for launching such a lifeboat from an elevated position on the structure and for towing same to a safe distance therefrom.

The system is intended to overcome the difficulties and dangers encountered when launching lifeboats, particularly on the weather or windward side of, for example, a drilling platform where there is a tendency for the boat to be driven into the legs and pipework of the platform thus preventing rapid escape, for example, in the case of fire and when burning debris may fall into the sea from a position directly above the boat.

Several systems have been proposed for this purpose, the most successful of which has been described in our International patent application WO 91/03398 which referred to a system in which a submerged buoyancy device is tethered to the bow of a lifeboat suspended, before launch, on single or double davit falls, by a cable which is retained by a release mechanism fixed near the base of the structure and passed around a submerged guide member fixed at a similar level on or near the sea bed but at a distance off the structure such that when the cable is released as the boat is lowered onto the surface, the rising buoyancy device tows the cable and thus the boat away from the structure.

The present invention may be distinguished from the system earlier described by several features of modification and improvement which have been developed in the interest of increased efficiency and safety, but which in no way detract from the basic concept defined in our earlier patent application.

According to the present invention, there is provided a system for launching a lifeboat from an elevated position on a structure such as an offshore drilling platform, and for towing the lifeboat to a distant position away from the structure, the system comprising a submerged buoyancy device tethered to the lifeboat by means of a towing cable which passes from the lifeboat to the submerged buoyancy device, and a submerged guide member fixed to the seabed at or in the region of the distant position to which the lifeboat is to be towed, said towing cable passing around said guide member between the lifeboat and the buoyancy device; characterised in that the towing cable extends upwardly directly from the guide member towards the surface and towards the lifeboat.

Modifications and improvements will now be described, by way of example only, with reference to the accompany drawings in which:

DESCRIPTION OF THE PREFERRED EMBODIMENTS

Figure 1:
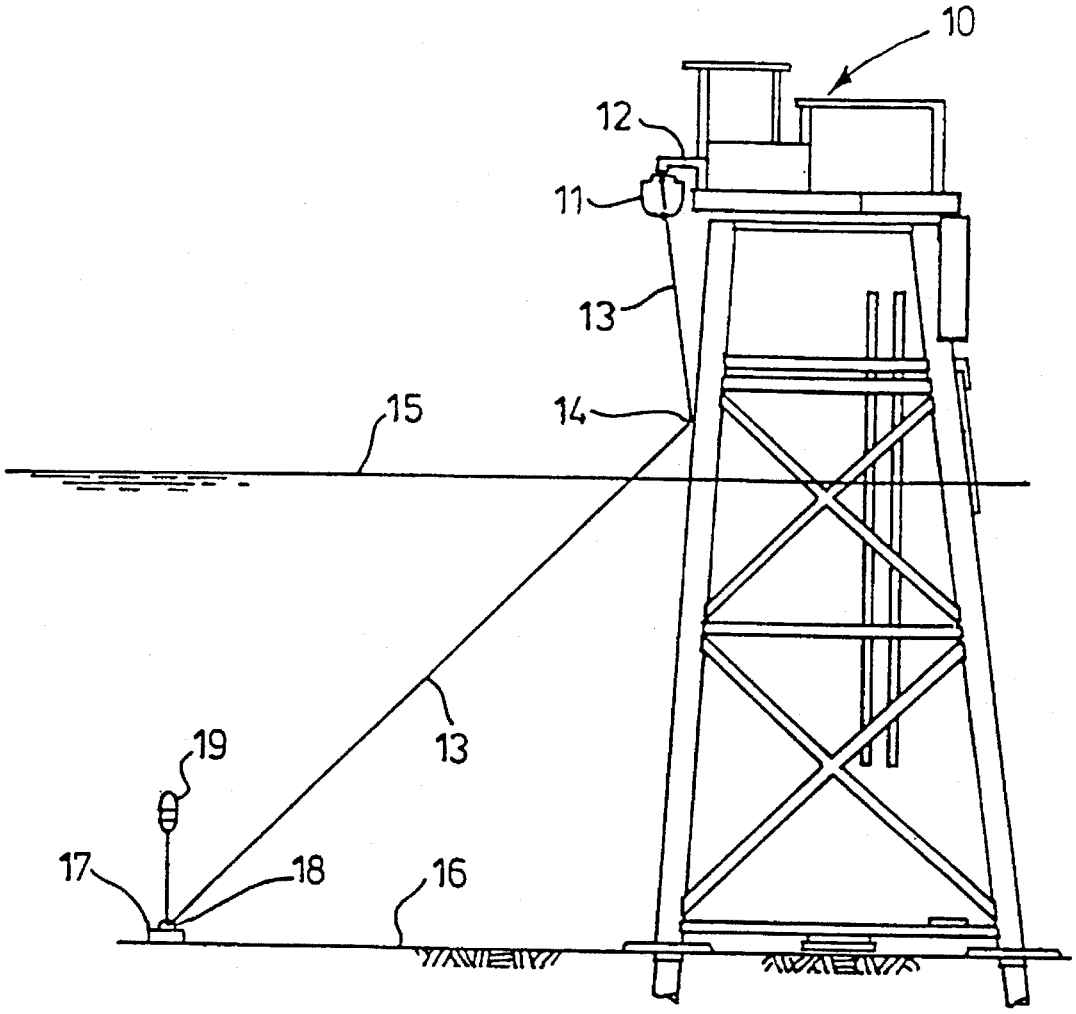
FIG. 1 is a schematic illustration of a system for launching a lifeboat and made in accordance with one aspect of the present invention.

Referring now to FIG. 1 which shows a lifeboat stowed in readiness to be launched from a fixed marine platform 10 which in this example, is a fixed structure. The lifeboat 11 is suspended on double falls i.e two spaced cables (not shown in FIG. 1), on a pair of davits 12 fixed to the structure 10. Thus, the fore and aft regions of the lifeboat are suspended from the davits 12, and a towing cable 13 is attached adjacent the bow of the boat by means of a device (not shown) which is releasable from within the lifeboat after launch.

The cable 13 passes downwardly from the bow of the lifeboat to a release mechanism 14 attached to a leg of the structure 10 close to but above the water line 15. Preferably, the position of release mechanism 14 is arranged to be just above the highest level attained by the tide.

From the release mechanism 14 the cable 13 passes downwardly at an angle approximately 45 degrees towards the sea bed 16 whereat there is provided an anchor block 17 having a fairlead 18 through which the cable 13 may pass. The free end of cable 13 above the fairlead 18 is secured to a submerged buoy 19. With the system set up in this way, the cable 13 extends upwardly from the fairlead 18 towards the lifeboat 11 at an inclined angle which in this example is approximately 45° from the horizontal.

Figure 2:
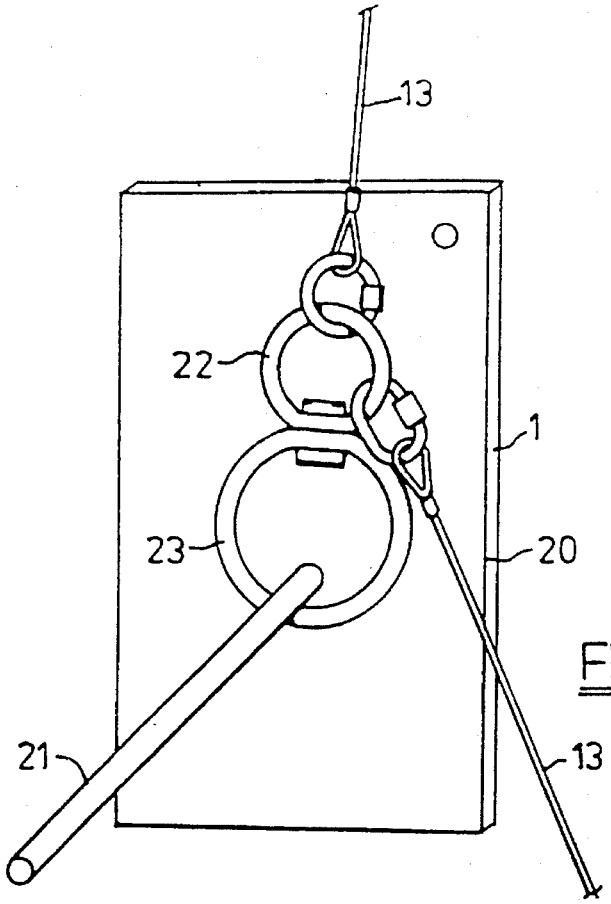
FIG. 2 is a more detailed view of one form of release mechanism adapted to operate automatically when the lifeboat is launched.

Referring now to FIG. 2, it will be seen that the release mechanism 14 comprises a plate 20 for attachment to the rig, and a rigid pin 21 which extends outwardly and downwardly at an angle of approximately 45° with respect to the plate 20.

As can be seen from FIG. 2 the cable 13 is divided at this position and attached to a figure-of-eight shaped eye member 22, a secondary ring 23 of which, in use, is freely located on pin 21.

In the operation of the device as illustrated in FIGS. 1 and 2, when the boat 11 is lowered on its falls from the davits 12 the ring 23 of release mechanism 14 becomes detached from pin 21 thus allowing the buoy 19 to commence to rise towards the surface 15. Since the cable 13 is attached to the bow of the lifeboat 11, as the latter descends towards the surface it is steadily turned outwards on a heading away from the structure 10 and constrained from rotation only by the double falls from the davits 12. Once the boat is on the surface, an internal release mechanism within the boat may be actuated to release it from the davit fails whereupon, by continuing ascension of the buoy, 19 the lifeboat is towed safely away to a position close to where the buoy will emerge. Since the length of cable 13 between the lifeboat 11 and the submerged guide fairlead 18 is minimised to assume almost a straight line, the boat may be towed outwardly to approximately one boat's length from the point at which the buoy 19 will emerge.

It will be appreciated that a launching system similar to that as described may be required for use also on a structure or vessel which is not fixed to the sea bed but which may, for example, be a semi-submersible platform held in position usually by a number of anchor lines. In this case, by providing a sufficient length of cable 13 between fairlead 18 and the buoy 19 before the lifeboat is launched, any movement of the structure on its anchor lines will be accommodated by rise and fall of the buoy above its anchor block 17.

In the case of an anchored structure a more positive release mechanism may be required such that the cable 13 cannot be released prematurely by movement of the structure but will be released once the tension in the cable above the release mechanism is slackened. Alternatively, the release mechanism may be provided with a device which can be deliberately actuated at the time of launch.

When compared with the system described in our International patent application WO 91/03398 wherein the release mechanism was positioned on or close to the sea bed, the relocation of the mechanism as illustrated in FIG. 1 at or near the water line is preferable in that, as stated above, it increases the potential distance by which the lifeboat may be towed since the towing cable is of reduced length. To achieve this, the release mechanism must be at a significantly different level from the guide fairlead 18. By placing the mechanism 14 just above the water line, the hook and eye mechanism is easy to install and maintain. If required, this mechanism may be positioned just inside the bounds of the legs of the structure 10 so that it cannot impale the lifeboat should the latter be driven towards the structure during launch.

In an alternative arrangement, the pin 21 may be pivotally attached to the plate 20 so that once the tension in the cable above the mechanism is released the weight of the pin will cause it to pivot downwardly to rest against the plate, thus avoiding any risk of impaling the lifeboat.

Figure 3:
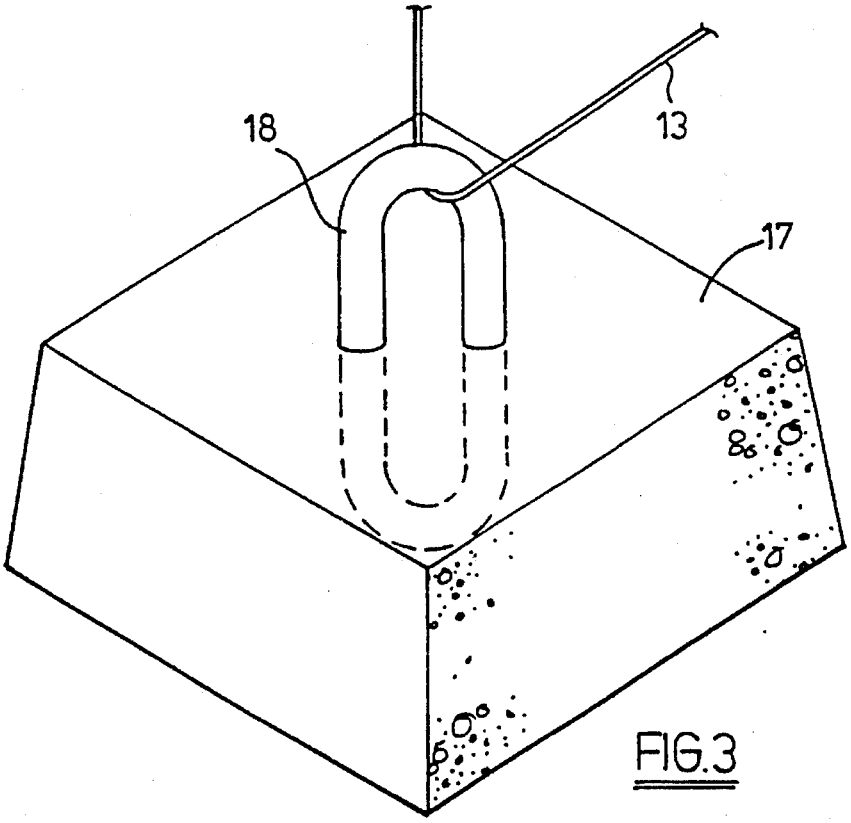
FIG. 3 is a view of a guide member through which a towing cable passes in the operation of the system.

Referring now to FIG. 3, the anchor block 17 may be a block of concrete some 1500 mm square and 800 mm high with a stainless steel fairlead 18 embedded therein. The fairlead is produced from stainless steel tube having a diameter in the region of 120 mm and defining an inverted U-shaped bend with a radius of some 150 mm, the overall height of the fairlead 18 of above block 17 being in the region of 500 mm. Thus, the fairlead 18 acts as a fairlead the tubular diameter of which is designed to provide a smooth bending action of the cable 13 as is passes through the fairlead. The width of the passage through the fairlead is sufficient to allow any obstructions on the cable such as the fittings for the hook and eye release mechanism 14 to pass freely through the fairlead.

Alternatively, the fairlead may be solid and constructed from a material which will resist corrosion and wear for a considerable period of time.

As an alternative to the anchor block 17, the fairlead 18 may be tethered to the sea bed by a cable, or it may be mounted on or form part of a pile driven into the sea bed, such that the fairlead is located at an appropriate depth to provide the required towing distance for the lifeboat.

It will be seen that the direction of passage of the cable 13 through the fairlead 18 may vary dependent upon the tidal conditions and the relative position of the fairlead with respect to the structure 10. Because the fairlead is of semi-circular formation the cable passes therethrough with a substantially constant degree of friction, irrespective of the direction from which the cable approaches the fairlead. This may be compared favourably with the alternative of a pulley mechanism. The fairlead 18 has no moving parts which would require maintenance and could become jammed or fouled.

It is quite intentional that the passage of the cable around the fairlead is frictionally opposed. When submerging the buoy, the force required is in excess of the buoyancy generated thereby owing to the friction of the cable passing around the fairlead. Typically, to submerge a buoy having 500 kilograms of buoyancy, will require approximately 800 kilograms of force applied to the cable, this force being a variable based on the design of the fairlead. Conversely, when the buoy is rising towards the surface, the force generated in the cable 13 and utilised for towing the boat is in the region of 350 kilograms. Once the lifeboat has momentum the cable 13 becomes relatively slack and so the friction of the cable passing around the fairlead is further reduced and the momentum of the boat continues to carry it forwards away from the structure. Should the boat be retarded in its progress owing to wind and current, the tension in the cable and thus the friction around the fairlead is increased thus preventing or reducing any tendency for the boat to be driven backwards towards the structure. Thus, the friction generated around the fairlead 18 permits the boat to travel forwards in a controlled manner.

In the launching process, the length of the cable 13 and the position chosen for the anchor block 17 and fairlead 18, are such that the buoy will reach the surface when the boat has been towed to approximately one boat's length from the buoy. This ensures that the boat may not collide with the buoy whilst simultaneously maximising the towing distance.

Typically, with a depth of water of some 60 meters, the anchor block is positioned some 86 meters away from the structure 10 with the lifeboat stowed some 20 meters above the water level. This will produce a towing distance along the surface of about 80 meters.

Figure 4:
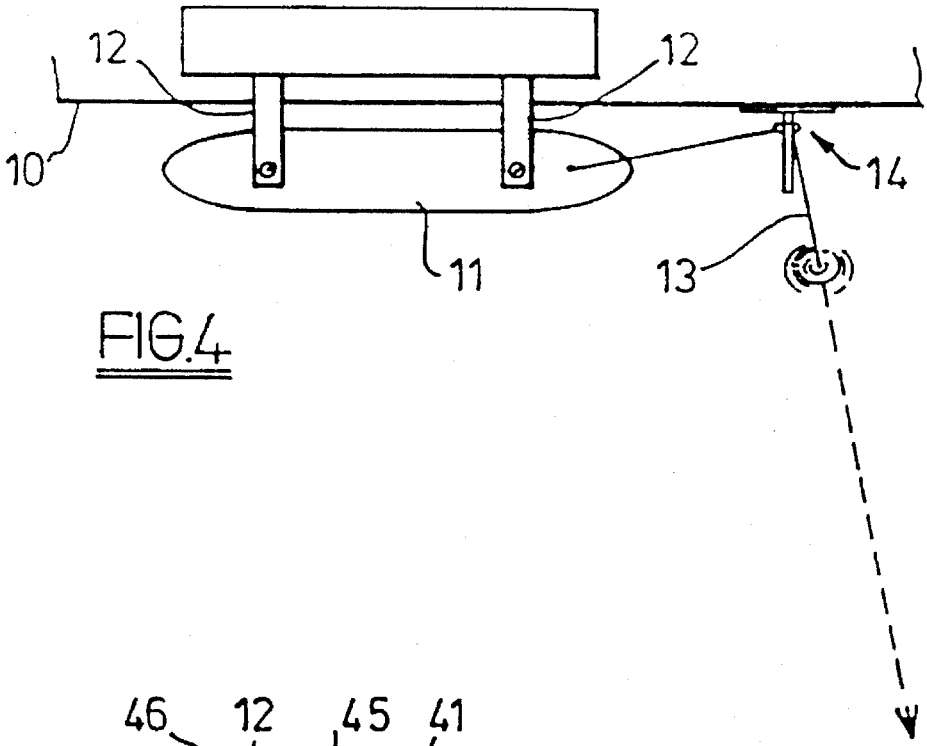
FIG. 4 is a schematic plan view of a lifeboat located in its stowed position prior to launch.

As can be seen from FIG. 4, the release mechanism 14 need not be placed directly vertically below the prow of the boat but is preferably forward of the prow so that when the boat is released there is no risk of any part of the boat becoming impaled on the pin 21 or any other part of the release mechanism. Also as can be seen, the position of the anchor block 17 need not be along a line 90 degrees with respect to the fore/aft axis of the boat or of the adjacent side of the structure. Ideally, the anchor block 17 is positioned so as to create the desired amount of rotation of the boat away from the structure before it reaches the surface. Too much rotation could cause the fall cables to jam on their pulleys, whilst too little rotation above the water level leaves the boat still to be rotated once it is in the water. The angular position of the block 17 in relation to the line of the structure and of the boat will be chosen according to the prevailing wind and tide to provide the optimum performance.

Additional features which render the system most effective may include the release mechanism 14 being painted in bright colours so as to make it easily visible as a potential obstruction for other operational activities. Also, if required, a slidable float may be attached to the cable 13 to serve not only to increase the visibility of the cable at the water line, to prevent collision by small craft approaching the structure, but also to keep the cable clear of fouling at sea level as a result of wave action pushing the slidable float up and down the cable.

It will be appreciated that the release mechanism 14 retains the cable 13 close to the structure at or near the water level thus enabling other vessels to approach the structure without fouling the cable. However, in certain cases where this is unlikely to occur, the release mechanism 14 may be dispensed with and the cable 13 may extend from the prow of the lifeboat 11 directly downwardly to the fairlead 18. In this case, the length of the cable 13 is further reduced to maximise the towing distance during a launch.

Thus a system is provided which will enable a lifeboat to be lowered in a controlled manner onto the water whilst being at least partially rotated towards a heading away from the structure before it reaches the water and thereupon to be towed steadily away from the structure for a distance of some 80 meters which is considered a safe distance from the structure in the event of fire or other hazard occurring thereon. Once the lifeboat has reached its fully towed distance it will turn head-on to the prevailing weather which is a combination of wind, current and tide and will set back approximately one or two boat lengths from the buoy. In this position it will be held safe in a location which will be known to rescue personnel so that the occupants of the lifeboat may be rescued as soon as possible.

During the launching process since the boat is under way it may be steered to avoid any obstructions. In the event that an obstruction cannot be avoided the occupants of the boat may release the towing cable by means of a quick release mechanism operable from within the boat. If this should occur the buoy will continue to rise to the surface but in view of its own hydro-dynamic drag and the cable friction around the fairlead 18 the buoy will not travel upwardly at such a speed as to cause damage by impact with any vessel located above it. Should its rise require further retardation this can be accommodated by installing obstructions on the cable in such a position thereon that just prior to the buoy reaching the surface these obstructions will pass through the fairlead 18 and will cause a retarding action on the cable thus to reduce the velocity of the buoy to a manageable degree. Such obstructions, may, for example be rubber rings fixed to and surrounding the cable at spaced distances.

The launching system may be applied to lifeboats suspended on either twin or single falls. In the case of a single-fall lifeboat such as a circular inflatable liferaft, the presence of the towing cable prevents the craft from spinning during its descent onto the water. The controlled descent enables the occupants to retain stability and a sense of direction so that the boat may be steered safely away from the structure as it is towed away.

The towing action of the system will commence even in the event that the falls release mechanism on the boat is not activated as soon as the boat reaches the surface.

Once the lifeboat has reached its safe moored position close to the buoy it is preferable that means are provided to enable the entire boat to be recovered by a rescue craft without the need for the lifeboat hatches to be opened. The occupants need to be transferred from the lifeboat either to a helicopter or fast rescue craft or to some other vessel. Under severe weather conditions this can be hazardous. It is essential that no doorways or hatches on the lifeboat be opened thus destroying its water tightness, otherwise the boat could easily flood, capsize and sink.

Figure 5:
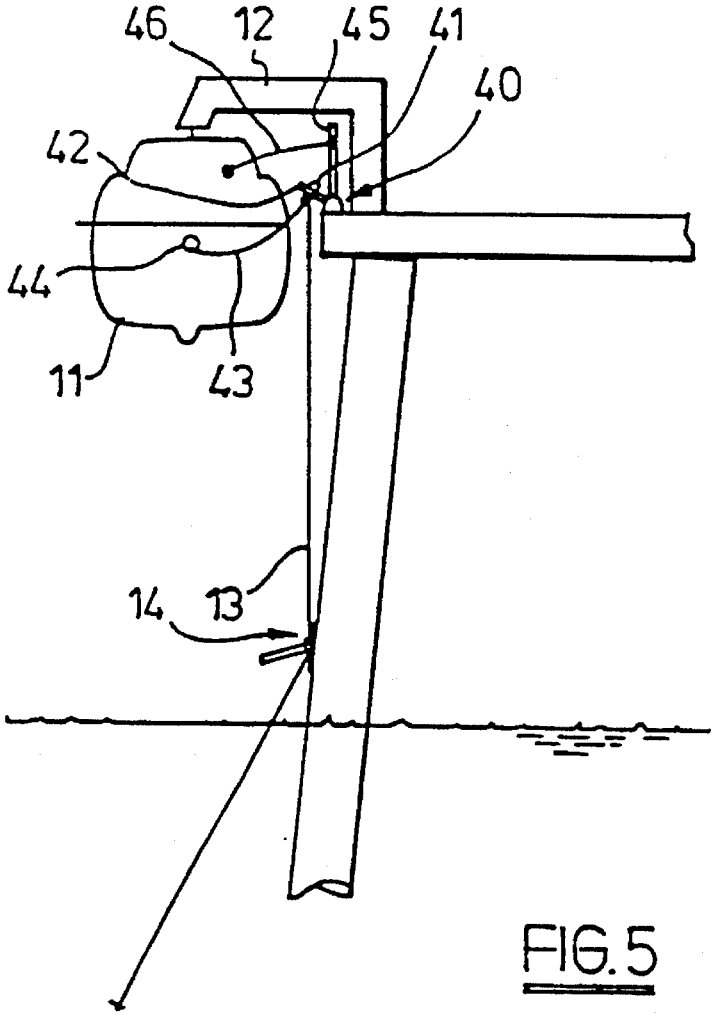
FIG. 5 is a view similar to FIG. 1, illustrating a modified launching system.

Referring now to FIG. 5 in a launching system modified with respect to that illustrated in FIG. 1, the cable 13 above the release mechanism 14 may pass, instead of directly to the bow of the lifeboat 11, to a secondary release mechanism generally indicated at 40. This incorporates a pin 41 or the like over which the upper end of the cable 13 is located by means of a ring 42. Also attached to the ring 42 is a loose line 43 which is connected to the bow of the lifeboat at 44. Thus, with the lifeboat 11 suspended on davits 12 the tension in cable 13 generated by the buoyancy device 19 is not directly applied to the lifeboat 11. However, when the lifeboat is launched, a release lever 45 may be actuated to release the ring 42 and cable 13 from the pin 41 so that the tension in cable 13 is then applied via the line 43 to the lifeboat bow, and the launch procedure can continue. Should the personnel occupying the lifeboat fail to actuate lever 45, this will be actuated automatically by an override release lanyard 46 connected between the lever 45 and the lifeboat 11 so that as the lifeboat descends from the davits the lever is automatically actuated to remove the cable 13 from the pin 41. The lanyard 46 provides only a weak link to the lever 45 and is designed to snap or become detached either from the lever or from the lifeboat as the latter descends.

The two-part release mechanism described in relation to FIG. 5 thus enables the boat to be serviced and, if necessary, removed from the davits 12 without affecting the "loaded" status of the release mechanism. Also, the mechanism is easier to install not being connected directly under tension to the lifeboat. Furthermore, for practical reasons, for example to prevent snatching, it is preferable not to have the tension in the cable 13 a permanently imposed upon the lifeboat.

Most lifeboats are equipped with an engine which, is started before the launch takes place. With conventional launching systems the launch procedure is abandoned if the engine should fail or not run easily. This ensures that once the boat is launched it can be driven under power to a safe distance from the point of launch. With the present system whereby the lifeboat is towed away from the structure by the rising buoy, although the engine will, in practice, still be started before launch, the launch may proceed even if the engine should fail. The system incorporates the minimum of mechanically operated parts. It is thus simple and inexpensive in manufacture and installation and is entirely reliable. Thus, safety is ensured at minimal cost.

Several lifeboats disposed around a fixed or floating structure or vessel may be provided in readiness for launch, whilst the principal parts of the mechanism which ensure that launching will be carried out efficiently, are visible for inspection on a regular basis without removing the system from its condition of readiness.

I claim:

1. A system for launching a lifeboat from an elevated position on an offshore structure, and for towing the lifeboat to a distant position away from the structure, the system comprising a submerged buoyancy device tethered to the lifeboat by means of a towing cable which is attached to and passes between the lifeboat and the submerged buoyancy device, a submerged guide member fixed to the seabed at or in the region of the distant position to which the lifeboat is to be towed, said towing cable passing around said guide member between the lifeboat and the buoyancy device, and a release mechanism fixed with respect to the structure to retain the towing cable before launch, said release mechanism being disposed at a position to be exposed above the water line; characterized in that the towing cable extends upwardly directly from the guide member towards the surface and towards the lifeboat, and in that the release mechanism includes means to release the towing cable completely from the structure as the lifeboat descends from the elevated position such that no Connection remains between the structure and the towing cable and between the structure and the buoyancy device.

2. A system for launching a lifeboat according to claim 1, wherein the towing cable extends upwardly from the submerged guide member to the lifeboat in such a manner as to assume, at least substantially, a straight line.

3. A system for launching a lifeboat according to claim 1 or claim 2, wherein the towing cable extends directly from the submerged guide member to a position on or immediately adjacent the lifeboat at said elevated position.

4. A system for launching a lifeboat according to claim 1, including two release mechanisms disposed on the structure, one close to the waterline and the other adjacent the lifeboat at its elevated position and connected to the lifeboat by a line which remains untensioned until the lifeboat is to be launched, means being provided to release said other mechanism upon or during the launch procedure.

5. A system for launching a lifeboat according to claim 4, including means to ensure that the towing cable is released automatically from said other release mechanism as the lifeboat is lowered.

6. A system for launching a lifeboat according to claim 1, wherein the structure is fixed to the sea bed.

7. A system for launching a lifeboat according to claim 1, wherein said guide member comprises a fairlead attached to the sea bed, through which the towing cable passes freely between the lifeboat and the buoyancy device.

* * * * *